United States Patent [19]

Vogelzang

[11] Patent Number: 5,005,555

[45] Date of Patent: Apr. 9, 1991

[54] WOOD BURNING APPARATUS

[76] Inventor: Steven J. Vogelzang, 555 Bay View Ave., Holland, Mich. 49423

[21] Appl. No.: 483,741

[22] Filed: Feb. 23, 1990

[51] Int. Cl.[5] ..... F24C 1/00

[52] U.S. Cl. ..... 126/60; 126/289

[58] Field of Search ..... 126/285 R, 289, 281, 126/58, 60, 65

[56] References Cited

U.S. PATENT DOCUMENTS

| | | | |
|---|---|---|---|
| 1,012,266 | 12/1911 | Miller | 126/292 |
| 1,230,882 | 6/1917 | Filbey | 126/292 |
| 1,872,213 | 8/1932 | Anderson | 126/285 R |
| 2,142,461 | 1/1939 | Swearingen | 126/292 |
| 2,149,565 | 3/1939 | Anderson | 126/292 |
| 4,261,325 | 4/1981 | Duncan et al. | 126/58 |
| 4,326,495 | 4/1982 | Millar | 126/77 |
| 4,406,277 | 9/1983 | Russo | 126/77 |

OTHER PUBLICATIONS

Federal Register, Part II, Environmental Protection Agency, Feb. 18, 1987, pp. 4994–5066.

*Primary Examiner*—Carroll B. Dority

*Attorney, Agent, or Firm*—Price, Heneveld, Cooper, DeWitt & Litton

[57] ABSTRACT

A wood burning apparatus capable of burning 5 kg per hour of wood or more with the combustion products exiting the apparatus through a collar which is fastened to the wood burning apparatus. A rotatable shaft passes through the collar and has a damper plate welded thereto within the collar. The damper plate has a pattern of apertures therein which will allow the passage of the combustion products when the damper plate is in the closed position, that is, in a position normal to the flow of combustion products through the collar. The collar and rotatable damper are also disclosed herein.

1 Claim, 1 Drawing Sheet

WOOD BURNING APPARATUS

BACKGROUND OF THE INVENTION

On Feb. 18, 1987, the Environmental Protection Agency (EPA) published in the Federal Register, Volume 52, No. 32, 40 CFR Part 60 entitled "Standards of Performance for New Stationary Sources, Standards of Performance for New Sources, Residential Wood Heaters." These regulations were proposed to control the burgeoning wood stove industry which many believed was substantially adding to the air pollution problem in the United States. The states of Oregon and Colorado had already passed requirements for wood burning devices to control the emission of particulate matter and potential carcinogens.

In the period when the proposed regulations were issued, so-called airtight stoves were very popular. These wood burning stoves consumed a small amount of wood over a long period of time and generated a steady source of heat. The slow combustion of the wood, however, resulted in a large amount of particulate matter being emitted from the chimney attached to the airtight wood burning heater. In an attempt to clean up the air in areas where wood burning residential heaters were in common usage, the Environmental Protection Agency proposed stringent requirements for wood burning stoves of the airtight variety. The Environmental Protection Agency proposed dates after which it would no longer be possible to use the then currently available airtight stove. The EPA recognized that conventional wood burning fireplaces were not in this same category or did not pollute as much as the airtight stoves in view of the high volume of air to fuel used and in view of the high burning rate and, in turn, the combustion temperature of a fireplace which would consume the particulate material In recognition of this, the EPA also proposed limits above which a wood heater did not have to be certified and would be exempt from the proposed regulations. The two proposed criteria were at least a 35:1 air to fuel ratio and a burn rate of at least 5 kg of wood per hour. If a wood burning heater operated at or above these limits, it was believed that it would produce a very small amount of particulate material and pollutants.

Since the above-quoted exemption criteria would require the wood burning stove to burn wood at a more rapid rate than an airtight stove, the EPA placed limits on the construction of wood burning residential heaters so that the user of the heater would not alter it to slow the combustion rate. For example, a heater could not have secondary air input which could be blocked off by the homeowner using aluminum tape or the like after the unit had been certified. Also, the normal non-precision fits between the cast iron parts making up the wood burning heater could not be caulked or sealed with aluminum tape after the unit had been certified. There was also a tendency on the part of the homeowner to remove the damper from the chimney of the fireplace so that it did not interfere with the small volume of smoke emitted by an airtight wood burning heater.

In order to become exempt from the EPA requirements, it was necessary for a wood burning residential heater to operate with the wood inlet door closed, and with the damper for the air inlet closed, as they would normally be produced by the factory without subsequent modification. Also, knowing the tendency of homeowners to remove the damper or other closure, the EPA made it a requirement that the heater have a damper permanently attached which could not be removed readily by a homeowner using household tools.

In view of the stringent requirements proposed by the EPA, many companies went out of the wood burning stove business Several of the larger companies produced catalytic secondary combustion chambers to reduce the amount of pollution which while effective substantially increased the cost of the stove. It was also possible, as noted above, to produce a wood burning heater which was exempt from the EPA requirements since it operated under conditions which substantially reduced the amount of particulate material and air pollutants being emitted from the wood burning heater.

SUMMARY OF THE INVENTION

In accordance with the present invention, an improved wood burning heater has been developed which can burn wood at the rate of at least 5 kg per hour with a permanently attached damper, as required, which when closed or placed in a position normal to the stream of exhaust products being emitted by the wood burning heater, still allows the wood burning heater to burn at least 5 kg of wood per hour. In accordance with the present invention, a wood burning heater was invented which operates at a high enough temperature to substantially consume all particulate matter contained in the exhaust products when consuming wood at the rate of at least 5 kg per hour. The heater has a fire box for containing wood to be burned and an exhaust port for the emission of the combustion products. The heater also has an access door for adding wood to the fire box and an air controller for regulating the amount of air entering the fire box which is normally in its closed position when burning wood at the rate of 5 kg per hour. A collar is provided for attachment about the exhaust port on the fire box and an adjustable damper is permanently installed in the collar having at least one aperture therein that, when in the closed position, will allow the passage of the combustion products produced during the burning of wood at the rate of at least 5 kg per hour.

DETAILED DESCRIPTION OF THE PREFERRED EMBODIMENTS

Figure 1:
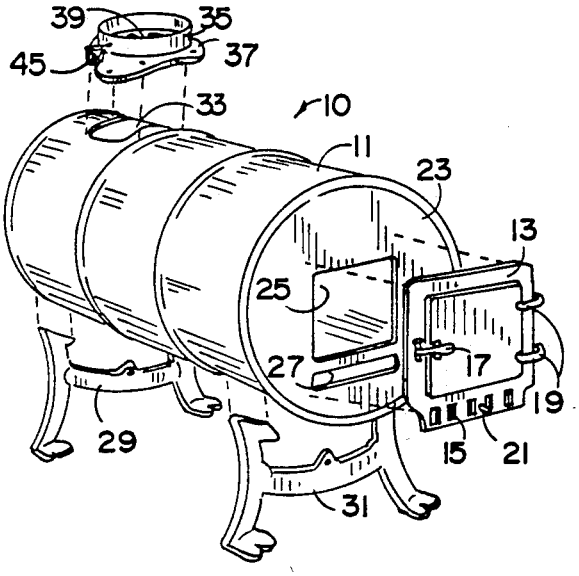
FIG. 1 is a partially exploded perspective view of a barrel stove showing the collar positioned above the exhaust port.

Referring to FIG. 1, a barrel stove is shown and indicated generally by the number 10. The barrel stove is usually made from a 30 or a 55 gallon metal drum 11 to which is attached the several parts of a commercially available kit to turn the metal drum into a wood burning stove. The kit usually comes with a door frame 13, a door 15 for adding wood to the barrel stove, a door latch 17, a pair of hinges 19 for fastening the door to the frame 13, and an air damper 21 for controlling the amount of air entering the barrel stove.

The barrel 11 has an end 23 in which two apertures 25 and 27 have been cut. The aperture 25 aligns with the door 15 and the aperture 27 aligns with the air flow damper 21. The frame 13 is bolted to the end of the barrel with the door opening and air vent in line with the cutout portions in the end of the barrel.

A pair of supporting legs 29 and 31 are provided for stabilizing the round metal barrel and for supporting it above the ground, floor or on whatever supporting non-combustible surface it is mounted. At the top rear end of the drum an aperture 33 is open which forms an exhaust port for the combustion products from the wood burning in the barrel stove. The usual barrel stove kit provides a simple collar for fastening about the exhaust port 33 to which a suitable stove pipe can be fastened to carry the combustion products out of the area being heated. The usual collar is just that, a simple circular or rectangular cast iron piece which corresponds to the configuration of the aperture 33 cut in the top rear portion of the metal barrel 11. As mentioned above, that type of barrel stove is no longer acceptable to the EPA. The EPA requires the presence of a damper on the wood burning apparatus. Also, the damper plate must not be capable of being readily removed by the homeowner using household tools.

Figure 2:
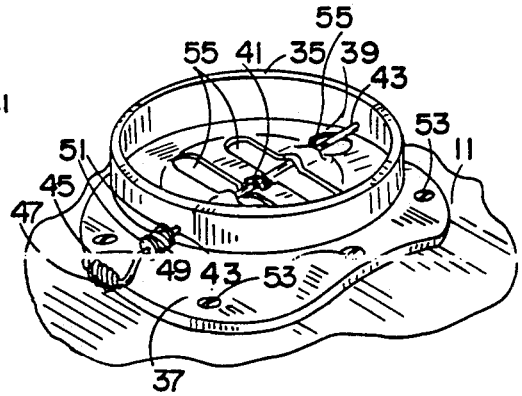
FIG. 2 is a fragmentary perspective view showing the collar and damper in position on the barrel stove of FIG. 1.

Referring now to FIGS. 1 and 2, in accordance with the present invention, a collar 35 is shown extending upwardly from a shaped flange 37 which conforms to the curvature of the top surface of the metal drum 11. The collar and flange are made of cast iron and can be formed of one or two pieces. It is preferred to have the collar and flange cast as a single piece. A damper 39 is mounted within the collar 35 and is supported on a shaft 41 which is pivotally supported in a pair of oppositely positioned apertures 43 in the collar 35. The damper 39 is welded 40 to the shaft 41 to prevent its being readily removed by the homeowner using household tools. The periphery of the damper substantially conforms to the inner dimensions of the collar which can be of any shape. One end of the rod 41 is shaped into a handle 45 about which a coil of heavy gauge metal wire is wound 47 to provide a cool grip for turning or adjusting the damper. A coil spring 49 is compressed against the collar 35 between two washers 51, one at each end of the spring. The spring pressing against the outer surface of the collar 35 enables the damper 39 to be held in its adjusted position. The flange 37 is fastened to the top of the drum 11 by suitable fasteners such as threaded nuts and bolts or threaded screws 53. A sheet of insulating material (not shown) can be placed between the flange 37 and the top of the drum 11 to preclude combustion products from escaping from that joint into the heated area.

In order for the wood burning stove to be exempted from the requirements of the EPA, it must burn at least 5 kg of wood per hour with the door 15 and the air vent, or air damper 21 closed and with the damper plate 39 closed, as shown in FIGS. 1 and 2. For this combustion rate the air to fuel ratio should be greater than 35:1 to meet the EPA requirement for exemption. The present inventor has determined through extensive experimentation that a pattern of apertures can be opened in the damper plate 39 which will allow the damper plate to still perform its useful function of controlling the burning rate of the wood in the barrel stove while at the same time allowing the exhaust products to be emitted without smoke being forced out of the barrel stove through the door and air vent into the space to be heated due to the inability of the closed damper to pass the volume of exhaust products produced by the burning of 5 kg per hour of wood. The apertures in the damper plate 39 enable the damper to be fully closed, as required to meet the EPA conditions for exemption and still enable the exhaust products, smoke, to pass from the wood stove safely up the chimney.

Figure 3:
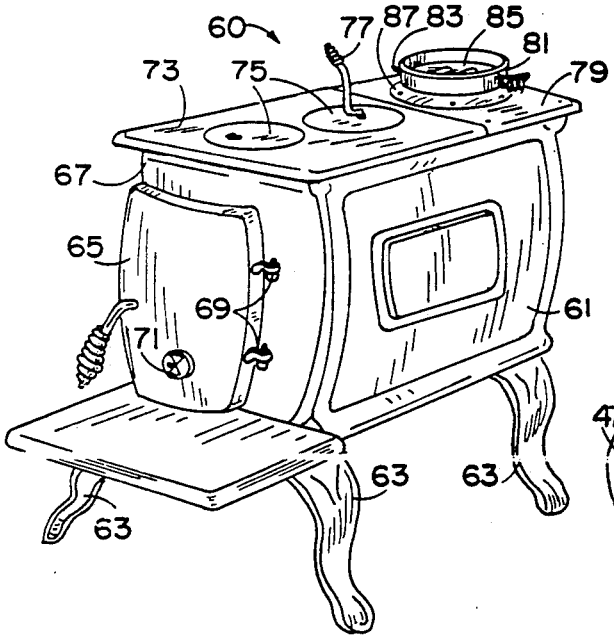
FIG. 3 is a perspective view of a cast iron box wood stove showing a collar and damper in position on the exhaust port of the stove.

The same damper configuration can be applied to the box wood stove indicated generally by the number 60 in FIG. 3. The box wood stove is made of several cast iron members which are joined together to form the finished stove. The stove has a cast iron fire box 61 supported by spaced legs 63. A door 65 is hingedly supported on the front face 67 of the box wood stove by a pair of spaced hinges 69. An air vent 71 is provided near the bottom of the door 65. A flat plate 73 closes the front portion of the top of the wood burning stove. A pair of metal lids 75 are positioned in apertures in the top plate 73. Each of the lids 75 can be lifted out of position by a suitable handle 77. Near the back of the top portion of the stove 60 a second plate 79 is fastened in position. The plate 79 has an aperture therein through which the exhaust products from the combustion of the wood escape. In the past, as in the case of the barrel stove, a simple collar was placed about this aperture to which the chimney pipe could be attached to safely emit the smoke out of doors. In accordance with the recent EPA regulations, the collar must now be fastened about the exhaust port and must contain a damper plate which cannot be readily removed by the homeowner using household tools. As can be seen in FIG. 3, a collar 81 supports a rotatable shaft 83 upon which a damper plate 85 is permanently attached. The collar 81 is attached to a flange 87 which is permanently attached to the piece 79 on the top of the box wood stove.

Figure 4:
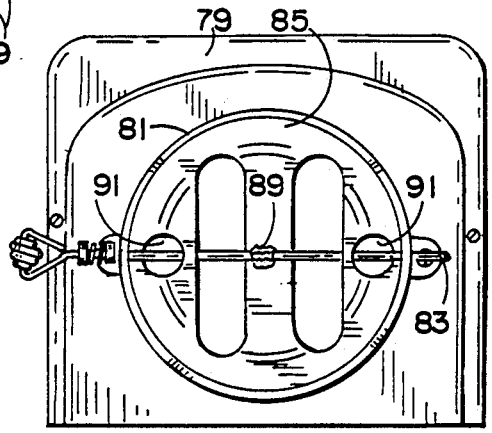
FIG. 4 is a partial plan view of the stove of FIG. 3 showing the collar and damper, with the damper in the fully closed position.

Referring to FIG. 4 for clarity, the damper plate 85 can be seen supported on the rod 83, which passes through aligned apertures (not shown) in the collar 81. In order to make the damper plate non-removable by the homeowner, the damper plate is welded at 89 to the rod 83. The weld permanently holds the damper plate in position. The damper plate 85 has a pattern of apertures to allow the combustion products to escape from the box wood stove when burning at the rate of 5 kg of wood per hour and with the damper plate closed, as shown in FIGS. 3 and 4.

The improved wood burning heaters of the present invention are exempt from the EPA requirements in view of the reduced amount of particulate material, and other pollutants emitted from these stoves, and in view of the higher combustion temperature employed within these stoves, as a result of the high burn rate of the wood. The wood burning stoves operate very much in the order of wood burning fire places which are also exempt in view of the high combustion rate and air to fuel ratio. The wood stove of the present invention also does not require secondary burning or a catalytic device to remove particulate material. It is known that these secondary devices can become clogged or coated with particulate material over a period of time and reduce the efficiency of the wood burning stove and cause the wood burning stove to emit large amounts of particulate material and pollutants. The wood burning stove of the present invention is substantially less expensive than the stove with secondary burners in not requiring the secondary burner.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. A wood burning heater which operates at a high enough temperature to substantially reduce the amount of particulate matter contained in the exhaust products when consuming wood at the rate of at least 5 kg per hour comprising:

a fire box for containing wood to be burned having an exhaust port for the emission of the combustion products produced by the burning of wood in said fire box;

an access member for adding wood to said fire box;

an air controller for regulating the amount of air entering said fire box and which is normally in its closed position when burning wood at the rate of at least 5 kg per hour;

a cast iron collar having an outwardly extending peripheral flange having apertures therein, fastening means extending through said openings and attaching said flange to said fire box about said exhaust port;

a rotatable shaft extending through aligned apertures in said collar;

a handle on one end of said rotatable shaft and a spring positioned on said rotatable shaft between said handle and said collar, said spring holding said damper in position when moved;

a cast iron adjustable damper plate permanently installed in said collar, said damper plate being welded to said rotatable shaft so that it cannot be removed without destroying the usefulness of said damper plate or said collar, said damper plate having a peripheral edge of substantially the same inner configuration as said collar and having at least one aperture therein which, when said damper plate is in the closed position, normal to the flow of combustion products through said collar, will allow the passage of the combustion products produced during the burning of wood at the rate of at least 5 kg per hour.

* * * * *